United States Patent [19]

Grant et al.

[11] 4,002,014

[45] Jan. 11, 1977

[54] BEAR DOWN SYSTEM FOR YARN HANDLING MACHINE

[75] Inventors: Charles A. Grant, Spartanburg; Charles C. Saylors, Greenville, both of S.C.

[73] Assignee: Grant's Textiles, Incorporated, Spartanburg, S.C.

[22] Filed: Dec. 23, 1974

[21] Appl. No.: 535,220

[52] U.S. Cl. ..... 57/54; 74/459

[51] Int. Cl.[2] ..... D01H 9/14

[58] Field of Search ..... 57/54; 74/459

[56] References Cited

UNITED STATES PATENTS

| | | | |
|---|---|---|---|
| 3,067,566 | 12/1962 | Van Dreven et al. | 57/54 |
| 3,073,177 | 1/1963 | Grabowski | 74/459 |
| 3,075,342 | 1/1963 | Lohest et al. | 57/54 |
| 3,336,739 | 8/1967 | Sanders et al. | 57/54 |

*Primary Examiner*—Richard C. Queisser
*Assistant Examiner*—Charles Gorenstein
*Attorney, Agent, or Firm*—Wellington M. Manning, Jr.

[57] ABSTRACT

An improved bear down system for a yarn handling machine is described and claimed herein. A traverse element such as a spinning or ring rail, a spindle rail, or the like is provided with a power driven ball bearing screw which is connected to an upright arm or the like of a means to traverse the element up and down. Control means allows the system to automatically bear down the traverse element at the appropriate time at completion of building of yarn packages on yarn carriers on the machine. Thereafter, new carriers are placed on spindle receivers for same and the cycle is repeated. The bear down system may be operated manually to move the traverse element up or down as desired.

18 Claims, 3 Drawing Figures

BEAR DOWN SYSTEM FOR YARN HANDLING MACHINE

BACKGROUND OF THE INVENTION

In yarn handling machines such as spinning frames, twisters or the like, textile carriers or bobbins are received over rotatable spindles along the length of the machine. While on the spindles, a package of yarn is built along the carrier after which the carrier is removed from the machine and an empty carrier substituted therefor. The particular building of the yarn package is determined by a unit called a builder motion which causes an element of the machine to move in a vertical plane along said carrier while yarn is deposited on the carrier at the juncture of same with the traversing element. Particular package design is thus very versatile, but always ends up in wrapping yarn along the majority of the length of the carrier, generally in a precise fashion. Regardless of the particular builder motion, once the package has been completed, it becomes desirable, if not necessary, to adjust the machine to permit proper removal of the full yarn carriers therefrom.

Historically, "bearing down" as the adjustment is referred to has constituted a manual operation where a foot lever was provided under the frame and was stepped on by the operator. The operator's weight then overcame a counter weight and forced a ring rail, etc. downwardly to a point adjacent the bottom of the yarn package for easy removal of the package from the spindle. Obvious problems have existed with manual bear down systems. They are difficult for all operators, but are near impossible to operate by some of the female operators who are not heavy enough or strong enough to apply the needed force. Textile companies were thus forced to use male operators. Automatic bear down systems were then added to the frames. These automatic systems have generally afforded a force of some type against a portion of the traverse apparatus to directly or indirectly cause the traverse element, normally the spinning rail, to be moved downwardly, adjacent the base of the spindle. Electromechanical, mechanical, hydraulic, pneumatic and other type systems have heretofore been utilized to provide the necessary bear down force.

Even with the automatic bear down systems, certain problems have continued to exist to prevent truly successful operation of the units. For example, a constant bear down, depending upon the type of rate of speed, has been quite elusive. In a pneumatic or hydraulic system, an initial lag exists after which a gradual build-up of power is produced with the graduated force applied. Further, since yarn is continually wound around the carrier during the period when the bearing down occurs, varying amounts of yarn are wound around the carrier, unless a constant rate is available. Unwinding of the yarn from the package is very important to success of the overall operation. Hence, it is important to provide a constant speed bear down system to realize winding of a constant amount of yarn around the carrier during bear down which can be easily removed from same. Moreover, once the rail is in the down position, it is customary to permit continued operation of the frame for a short period of time to permit the several additional wraps of yarn for production of a transfer tail. Transfer tails permit the proper thread-up of the yarn at subsequent operations and consistency of the transfer tail length adds to quality control and overall efficiency in general.

Mechanical bear down systems have been utilized in the past where a plurality of gears were employed in a very complex arrangement such that the mechanical approach has been considered impractical. As pointed out above, hydraulic and pneumatic systems have also encountered difficulty due to leaks and the like. Such problems led not only to possible malfunctions, but also to unsightly conditions surrounding the machinery, which are bad because of both aesthetic considerations and certain sightly hazards.

The present invention provides a bear down system that circumvents problems of the prior art. With the present system, a constant rate of bear down speed is realized, with the rate being variable. Secondly, the present system is automatic, and when coupled with the constant rate of speed, permits the attainment of a uniform yarn package. Furthermore, the present system may also be manually operated, if desired, which permits adjustment of the frame to facilitate convenience of spindle plumbing, changing of yarn travellers, machine maintenance, and the like.

SUMMARY OF THE INVENTION

It is an object of the present invention to provide an improved system for bearing down a traverse element on a yarn handling machine.

Another object of the present invention is to provide an improved bear down system for a textile frame.

Yet another object of the present invention is to provide a bear down system for a textile frame which provides a constant rate of speed and is self-locking at any position along the bear down travel.

Generally speaking, the present invention relates to a bear down system for a textile yarn handling frame having a traverse element and means to cause said element to traverse up and down, comprising a power unit secured to said frame, said unit comprising a ball bearing screw and a motor operatively associated therewith; a connector associated with said power unit and said traverse element movement means whereby actuation of said power unit causes a proportional movement of said connector and said traverse element movement means; and control means for said power unit, said control means determining the operational state of said power unit.

More specifically, the bear down system of the present invention embodies a ball bearing screw that is operatively associated with an upright or traverse arm of a traverse rocker arm. Preferably, a chain having good strength and low extensibility characteristics is utilized as the connector. Rotation of the screw causes movement of a ball nut therealong which causes an associated movement of the chain connector and upright arm. In turn, proportional movement of the traverse rail is effected. Power to the ball bearing screw is preferably provided by an electric motor, which may be self-braking, though other sources may be employed, as desired.

The ball bearing screw and motor power unit is preferably affixed to the textile frame by a bracket which permits self-alignment of the screw during movement of the ball nut to and fro along the screw. As such, regardless of the angular relationship between the connector and the upright arm, the ball bearing screw unit continues to function smoothly, in proper alignment.

One important feature of the present invention is the control unit for operating same. Preferably, three limit switches are provided along the length of traverse of the element, from an empty bobbin to a full bobbin. The lower of the three limit switches stops the operation of the bear down unit and resets the top two limit switches for proper actuation at the next doff. The middle limit switch is provided along the length of normal traverse of the rail and is continually engaged during normal traverse of the rail. Until activated, however, the middle limit switch is held out of operation by an open relay. Once the builder motion completes the yarn package, the top limit switch is then contacted by a portion of the traverse rail and, in turn, closes the open relay of the middle switch to activate the middle limit switch for operation. Thereafter, the middle switch is again contacted and actuates the bear down to provide power at the electric motor or other power source which, in turn, causes rotation of the screw, movement of the ball nut along the screw and movement of the upright arm to bear the frame down for doffing. Once the frame is down, the frame is turned off and doffed. After doffing, new bobbins are placed over the spindles and the builder motion is reset. Contact with the lower limit switch then reactuates the upper two limit switches. The bear down power unit per se is manually triggered to return the ball nut to the proper disposition for bearing down the frame at the next doff. In the reset position, the connector between the ball nut and the upright arm or other portion of the frame is slack. During the slack period for the bear down, the builder motion is under operation to afford a normal traverse cycle to the element.

A further important feature of the bear down system of the present invention is the ability to override the automatic control and manually move the traverse rail up or down at any time. The manual operation will permit ease of maintenance, ease of cleaning, ease of traveller changing or the like during normal operation of the frame.

DESCRIPTION OF THE PREFERRED EMBODIMENTS

Figure 1:
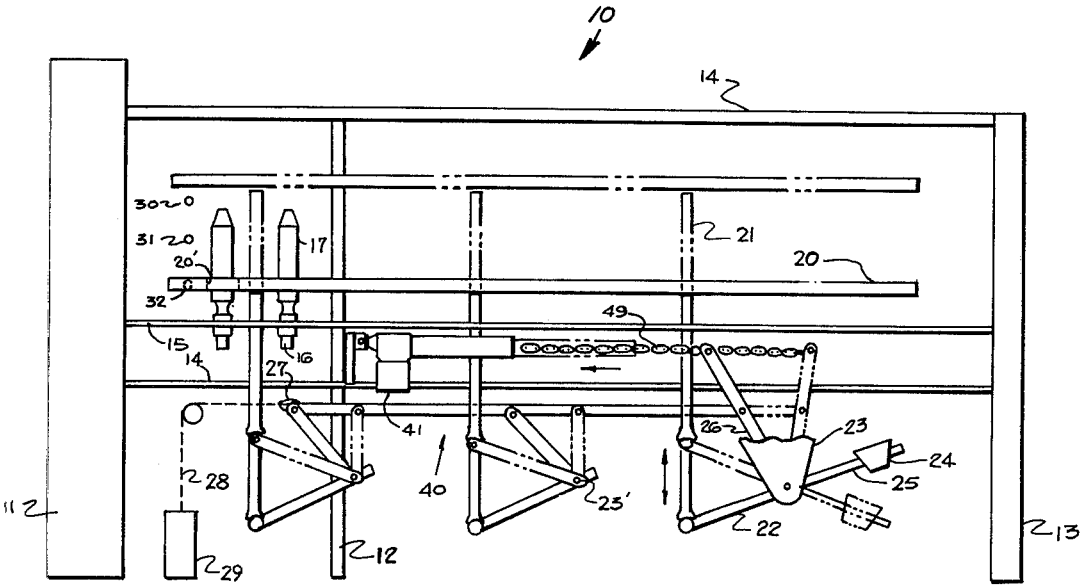
FIG. 1 is a side elevational view of a portion of a textile frame having a bear down system according to the present invention attached thereto.

Referring to the Figures, preferred embodiments of the present invention will be described in detail. A textile frame such as a spinning frame is illustrated in part in FIG. 1 as 10. The entire frame is not shown for same is well known to those skilled in the art and would serve no present useful purpose. Instead, only that portion of the frame that is required for a full understanding of the present invention is shown and discussed. The present bear down system may be installed on at least all traverse rail and Gwatley frames. The frame of FIG. 1 is thus provided for illustrative purposes only, and numerous other configurations may be employed.

Spinning frame 10 is provided with a suitable super structure that generally includes a Sampson 11 and vertical members 12 and 13. Extending horizontally between Sampson 11 and vertical members 12 and 13 are suitable horizontal structural members 14, and a spindle rail 15. Depending upon the particular system being employed, spindle rail 15 may be a traverse element or may be rigidly secured in place. Principally speaking, however, the spindle rail 15 is generally stationary and rotatably supports a plurality of spindles 16 in a conventional fashion along the length thereof. Spindles 16 receive textile carriers 17 thereover which, in turn, receive a yarn (not shown) which is wound therearound on the frame to produce a yarn package of a particular configuration. Drive means are provided for producing rotation of spindles 16 and for suitably supplying the yarn and winding same around the carriers 17. These means do not per se form a part of the present invention and are conventional in the art. As such, they have not been illustrated. Suffice it to say that an element 20, in this case a ring or spinning rail, is provided for the yarn carriers 17 and is driven in suitable fashion to traverse the length of yarn carriers 17. In conventional fashion, the spinning rail 20 has a plurality of openings 20' through which spindles 16 and carriers 17 pass and around which a yarn traveller (not shown) moves to convey the yarn being deposited onto carriers 17.

Spinning rail 20 is provided with a plurality of lifter rods 21 which are supported at the lower ends thereof by rocker arms 22. Rocker arms 22 are pivotally secured at brackets 23 which are secured to frame 10. One or more of the rocker arms 22 may have a counter weight 24 received on an arm 25 extending outwardly therefrom. At the pivot point 23' on bracket 23 an upright arm 26 is provided. Upright 26 is conventionally equipped with an arcuate plate 27 at an upper end thereof which receives a chain generally indicated as 28 that is associated with the builder motion 29. Under normal operations builder motion 29 causes a reciprocal movement of chain 28 which, in turn, acts on upright arm 26 to cause spinning rail 20 to move up and down, traversing spindle 16 and carrier 17. During this operation, normal placement of yarn around carrier 17 occurs and the bear down is deactivated, whereby connector 49 is slack and does not interfere with builder motion 29.

Once the yarn package on carrier 17 is complete, the control system for the bear down of the present invention is activated when contact is made with limit switch 30. Switch 30 causes a relay to close to activate limit switch 31 such that, at next contact between rail 20 and switch 31, the bear down system is actuated and bears down the frame. Switches 30, 31 and 32 are illustrated in the Figures as being mounted on the machine in the path of rail 20, to be contacted by rail 20 or an appurtenance thereto. The switches for the control system may, however, be contact actuated, may be proximity actuated or the like. Moreover, the switches could also be provided at any desirable location so long as the intended function is performed thereat.

The bear down system of the present invention is made up of a power unit 40, a sleeve 47 and chain 49 that comprise a connector and an electrical control system. Power unit 40 is loosely secured to a mounting bracket 60 at an enlarged opening 61 therefor. Mounting bracket 60 is then secured to a structural member of the frame, such as member 12 in FIG. 1. The loose connection at opening 61 then permits self-alignment of power unit 40 during operation of the bear down whereby the ball bearing screw component functions smoothly.

Upon actuation of the present bear down system, motor 41 of power unit 40 is energized and causes an associated bevel gear 42 to rotate and mesh with adjacent bevel gear 42'. Gear 42' is secured around a threaded screw shaft 43 whereby shaft 43 rotates. A ball nut 45 is received around threaded portion 44 of shaft 43 and has a helical raceway 45' along the inside thereof. A plurality of balls 46 are received between ball grooves 44' in threaded portion 44 and raceway 45' to support nut 45. Rotation of shaft 43 then causes nut 45 to move therealong, the direction of movement being determined by the direction of rotation of shaft 43. At least one return tube 45'' is provided to return balls 46 to another portion of nut 45. The rotary motion of screw 44 is thus converted to linear motion. Ball nut 45 is threadedly or otherwise secured to a sleeve 47 which extends beyond the terminal end of screw 44 and out of a housing 48 that surrounds screw 44. Sleeve 47 is secured in suitable fashion to connector 49 such as by an opening 47' that receives a portion of connector 49.

Figure 2:
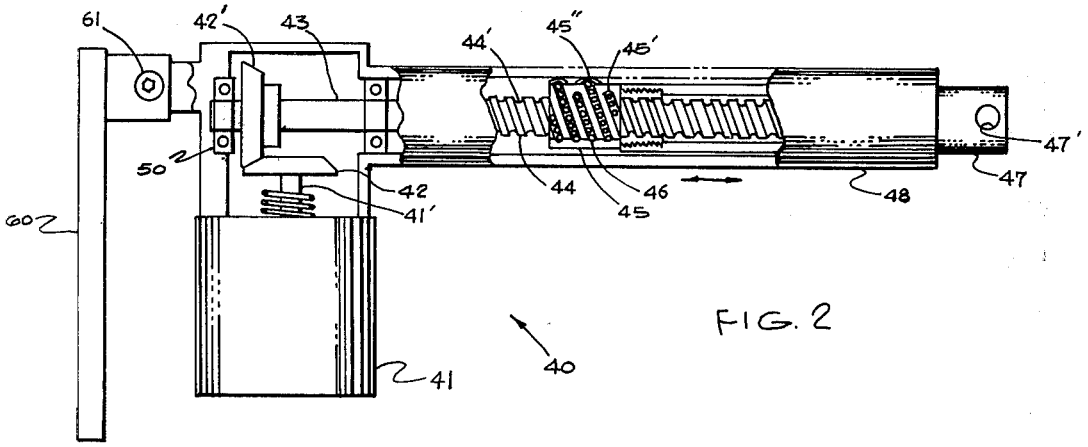
FIG. 2 is a side view in partial cross section of a ball bearing screw power unit according to the teachings of the present invention.

Referring more specifically to FIG. 2, power from a source (not shown) causes motor 41 to rotate bevel gears 42 and 42', one of which is secured to a motor shaft 41', while the other is secured to screw shaft 43. Motor 41, however, need not be electric, but is preferred and is thus symbolic of a source of power. Most preferably, motor 41 is sealed which thus avoids the necessity for lubrication while at the same time, not collecting lint, fly and the like at grease fittings. Shaft 43 is provided with suitable bearing supports 50 to support same for rotary motion. Threaded portion 44 of shaft 43 is provided with ball grooves 44' in which the plurality of balls 46 is received. A preferred ball bearing screw according to the present invention is commercially available from Warner Electric Brake and Clutch Company, Beloit, Wisconsin. According to the illustration of FIG. 1, movement of connector chain 49 to the left, as indicated by the arrow, occurs when ball nut 45 and sleeve 47 move to the left along screw 44. Upright 26 thus moves about pivot 23' of support 23 from an up position (shown in phantom in FIG. 1) to a down position. Lifter rods 21 move accordingly downward to a lower position and bring spinning rail 20 therewith. In the event that rotary motion of screw 43 is reversed, ball nut 45 moves outwardly, removing tension from connector chain 49 whereby a counter weight 24 on rocker arm 22 forces rail 20 upwardly.

Numerous physical arrangements are possible and are in use with the various brands of yarn handling machines that utilize bear down systems. Such is readily evident from a review of the prior art. The system of the present invention is quite suitable for each of them and needs only to be connected to the proper member for imparting traverse to the rail. Hence, while the particular illustration of FIG. 1 is not correct for all frames, it is symbolic in the sense of the correct disposition of the apparatus and the operation of same.

Figure 3:
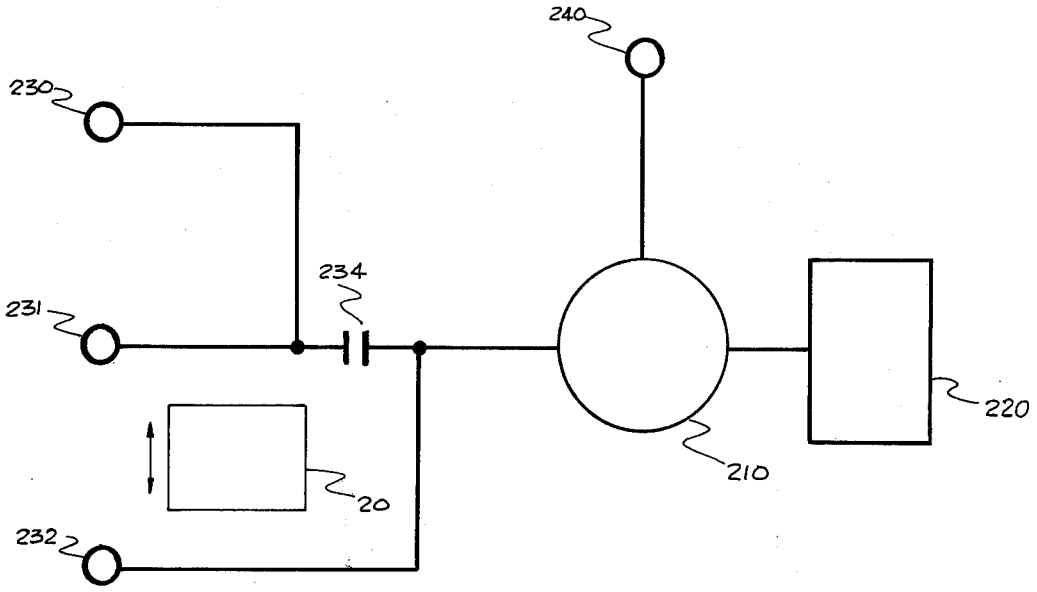
FIG. 3 is a schematic diagram of a control system according to the present invention.

In FIG. 3, electrical control system of the present invention is described. The motor or other power source 210 for actuating the present bear down is operatively connected to various switches as will be described hereinafter. A manual switch system 220 is provided which overrides the automatic controls and may be actuated at the option of the operator to achieve movement of the traverse rail up or down to a desired location. Primary automatic controls for motor 210, however, are provided by switches or contacts 230, 231 and 232, all of which are preferably disposed along a portion of the travel of traverse element 20 of the present invention for contact or proximity actuation. Switches 230, 231 and 232 may be provided at any location, however, so long as the location is coordinated to travel of the traverse element. Middle switch 231 actuates motor 210, but remains deactivated by a relay 234 positioned between same and motor 210 that remains open during building of the yarn package. Under normal traverse limits of the rail or other element 20, switch 231 is contacted, but remains deactivated and hence does not signal operation of the bear down. Once the yarn package is complete, the traverse element operates in an uppermost range of traverse and the upper switch 230 is actuated. Relay 234 is then closed by actuated switch 230 which activates switch 231. Next engagement of switch 231 actuates the system by energizing motor 210. Ball bearing screw shaft 43 then rotates and through the mechanism described above, the traverse element is borne down to its low, doff position. Bearing down of the frame in this fashion brings about a normal sequence of shutting down the frame after a suitable transfer tail is wound around bottom of the bobbin. The completed yarn packages are then doffed (removed from the spindle) and new yarn carriers are donned (placed over the spindle). Builder motion 29 is then reset, normally by depression of a switch 240 which causes the motor 210 to operate for a predetermined period of time to move ball nut 45 outwardly and thus reset the bear down for the next doff cycle. Likewise, next contact between the traverse element 20 and lower switch 232 reopens relay 234 and again deactivates switch 231. Thereafter, the bear down will not function automatically until the builder motion has completed the next cycle and switch 230 is again engaged at the upward end of travel of traverse element 20 to close relay 234 and reactivate switch 231 for actuation of the bear down system.

Having described the present invention in detail, it is obvious that one skilled in the art will be able to make variations and modifications thereto without departing from the scope of the invention. Accordingly, the scope of the present invention should be determined only by the claims appended hereto.

What is claimed is:

1. A bear down system for a yarn handling frame having a traverse element with associated means to move said element up and down comprising:

a. an enclosed power unit and means for securing said power unit to said frame in a self aligning manner, said power unit comprising a ball bearing screw actuator and a power source operatively connected thereto;

b. a connector secured between said ball bearing screw actuator and said traverse element movement means, whereby actuation of said power unit causes a proportional movement of said connector to effect movement of said traverse element; and c. control means for said power unit, said control means determining when said power unit is actuated.

2. A bear down system as defined in claim 1 wherein said power unit is loosely secured to said mounting means which is secured to said frame whereby said ball bearing screw is self-aligning during operation.

3. A bear down system as defined in claim 1 wherein said ball bearing screw comprises a threaded shaft mounted for rotary motion and a ball nut received around said threaded shaft, said ball nut having a raceway along an inner side thereof and having a plurality of balls received therein, said balls residing between ball grooves of said shaft and being moveable therealong, said ball nut further having return tubes for transporting said balls from one section of said nut to another.

4. A bear down system as defined in claim 1 wherein said control means comprise three limit switches located on said frame, location of said switches representing traverse travel of said element, operational condition of said control system being determined by the state of said switches.

5. A bear down system as defined in claim 4 wherein a first switch is connected to said power source and has a normally open relay therebetween, a second switch is actuated only when said yarn package is complete, to close said relay and activate said first switch for operation of said bear down, and a third switch for resetting said first two switches.

6. A bear down system as defined in claim 5 comprising further a manual switch for overriding said first, second and third switches and permitting manual operation of said bear down system and further, means for resetting said power unit.

7. A bear down system as defined in claim 5 wherein said switches are mounted on said frame and are engaged during appropriate traverse of said traverse element.

8. A bear down system as defined in claim 3 wherein said connector comprises a sleeve secured to said ball nut on said ball bearing screw with a flexible, low extensibility element secured to an end of said sleeve, an opposite end of said flexible, low extensibe element being secured to said traverse element movement means.

9. A rail bear down system for a yarn handling machine having a traverse rail, said rail having traversing means operatively connected thereto, and a builder motion associated with said traversing means to determine the traverse movement of same during the building of yarn packages on said machine comprising:

a. a bear down power unit and a mounting means for securing said power unit to said frame in a self aligning manner, said power unit comprising an electric motor and a ball bearing screw actuator, said power unit further being enclosed in a housing;
b. a connector secured to said ball bearing screw actuator and said rail traversing means, said connector being moveably proportionately to said actuator to effect a movement of said rail; and
c. control means provided on said machine and connected to said power unit to determine operational sequences of said bear down system.

10. A bear down system as defined in claim 9 wherein the ball bearing screw actuator comprises a threaded shaft, a ball nut received over said shaft and having a raceway on an inside thereof, and a plurality of balls received in said nut in said raceway, said balls riding between said threads on said shaft in ball grooves and causing said nut to move therealong during rotation of said shaft.

11. A bear down system as defined in claim 10 wherein the connector comprises a sleeve secured to said nut and extending over said threaded shaft, and a flexible, low extensibility member connected between said sleeve and said rail traversing means.

12. A bear down system as defined in claim 11 wherein said flexible, low extensibility member is a chain.

13. A bear down system as defined in claim 12 wherein said control means comprises a plurality of switches mounted on said machine along the travel of said rail, said switches becoming actuated by the presence of said rail at predetermined times to determine operation of said bear down system.

14. A bear down system as defined in claim 13 wherein a first switch is connected to said motor with a normally open relay therebetween, a second switch is provided adjacent the top of the rail travel path for actuation only after the yarn package is complete, said second switch being connected to said normally open relay to close same when actuated and thus activate said first switch, and a third switch adjacent a lower end of said travel path, said third switch being associated with said first and second switches and when actuated to reset said first and second switches.

15. A bear down system as defined in claim 14 wherein a further manual switch is provided with a time delay associated therewith, said further switch being associated with said motor to cause said actuator to run for a period necessary to reset said connector for the next bear down sequence.

16. A bear down system as defined in claim 15 wherein said motor is self-braking to hold said actuator at the point where the motor stops.

17. A bear down system for a yarn handling frame having a traverse element with associated means to move said element up and down comprising:

a. an enclosed power unit and means for securing said power unit to said frame in a self aligning manner, said power unit comprising a ball bearing screw actuator and an electric motor operatively connected thereto, said ball bearing screw actuator comprising a threaded shaft mounted for rotary motion and a ball nut received around said threaded shaft, said ball nut having a raceway along an inner side thereof and having a plurality of balls received therein, said balls residing between ball grooves of said shaft and being moveable therealong, said ball nut further having return tubes for transporting said balls from one section of said nut to another, said ball nut having a sleeve secured thereto and extending outwardly therefrom, residing around an end of said threaded shaft, said ball nut being moveable in and out of said enclosed unit;
b. a connector secured between a free end of said sleeve and said traverse element movement means, whereby movement of said sleeve causes a movement of said connector to effect movement of said traverse element; and
c. control means for said power unit, said control means determining operational sequences of said power unit.

18. A bear down system for a yarn handling frame having a traverse element with associated means to move said element up and down comprising:

a. a mounting bracket secured to said frame;
b. a power unit loosely secured to said mounting bracket to permit self alignment of said power unit thereabout, said power unit comprising a ball bearing screw actuator and an electric motor operatively connected thereto, said ball bearing screw actuator and said motor being enclosed by a housing, said ball bearing screw actuator having a sleeve secured to a portion thereof and being extendible out of said housing;

c. a flexible, nonextensible connector secured to said sleeve at one end and to said traverse element movement means at an other end, whereby actuation of said power unit causes movement of said sleeve and said connector to effect movement of said traverse element; and d. control means for said power unit, said control means actuating said power unit at a predetermined time and deactuating said power unit after said power unit has been actuated and has borne down the traverse element.

* * * * *